US005711386A

United States Patent [19]

Swietlik

[11] Patent Number: 5,711,386

[45] Date of Patent: Jan. 27, 1998

[54] EQUIPMENT TO REDUCE TORQUE ON A DRILL STRING

[76] Inventor: George Swietlik, Sandings Broadview Rd, Oulton Broad Lowestoft, United Kingdom, UK NR32 3PL

[21] Appl. No.: 596,304

[22] PCT Filed: Aug. 15, 1994

[86] PCT No.: PCT/GB94/01778

§ 371 Date: Apr. 10, 1996

§ 102(e) Date: Apr. 10, 1996

[87] PCT Pub. No.: WO95/05521

PCT Pub. Date: Feb. 23, 1995

[30] Foreign Application Priority Data

Aug. 17, 1993 [GB] United Kingdom ..... 9317128

[51] Int. Cl.[6] ..... E21B 17/10

[52] U.S. Cl. ..... 175/325.3; 384/508

[58] Field of Search ..... 175/325.1, 325.3, 175/325.6; 166/241.6; 384/508

[56] References Cited

U.S. PATENT DOCUMENTS

| | | | |
|---|---|---|---|
| 328,176 | 10/1885 | Bailey | 384/508 |
| 825,417 | 7/1906 | Rivetz | 384/508 |
| 1,517,027 | 11/1924 | Smith . | |
| 1,699,087 | 1/1929 | Woodmansee et al. . | |
| 1,737,578 | 12/1929 | Fentress . | |
| 1,801,294 | 4/1931 | Sutton . | |
| 1,831,999 | 11/1931 | Bull | 175/325.3 |
| 2,758,891 | 8/1956 | Kammerer | 175/325.3 |
| 3,361,493 | 1/1968 | Melton | 175/325.3 |
| 3,410,613 | 11/1968 | Kuus . | |
| 3,528,499 | 9/1970 | Collett . | |
| 3,907,048 | 9/1975 | Gray . | |
| 4,071,101 | 1/1978 | Ford . | |
| 4,372,622 | 2/1983 | Cheek . | |
| 4,606,417 | 8/1986 | Webb et al. . | |
| 4,796,670 | 1/1989 | Russell et al. . | |
| 5,054,937 | 10/1991 | Hanaway | 384/508 X |
| 5,148,876 | 9/1992 | Wilson . | |
| 5,261,498 | 11/1993 | Steinkamp et al. | 175/325.3 |
| 5,339,910 | 8/1994 | Mueller . | |

FOREIGN PATENT DOCUMENTS

| | | |
|---|---|---|
| 328244 | 8/1989 | European Pat. Off. . |
| 333450 | 9/1989 | European Pat. Off. . |
| 439279 | 7/1991 | European Pat. Off. . |
| 468230 | 1/1992 | European Pat. Off. . |
| 271839 | 3/1928 | United Kingdom . |
| 2248792 | 4/1992 | United Kingdom . |
| 2248906 | 4/1992 | United Kingdom . |
| 2257447 | 1/1993 | United Kingdom . |
| 2233690 | 2/1993 | United Kingdom . |
| 9100411 | 1/1991 | WIPO . |

*Primary Examiner*—William P. Neuder
*Attorney, Agent, or Firm*—Emrich & Dithmar

[57] ABSTRACT

A drill string torque-reducing sub-assembly is disclosed comprising: a hollow longitudinally-extending mandrel (1) capable of being coupled between adjacent first and second drill pipes in the drill string; and a sleeve (2) capable of freely rotating about the mandrel (1), the sleeve having an external diameter (18) intended to be larger than that of any connection component of the first or second drill pipe, and the sleeve (2) being prevented by bearings (16) mounted internally of the sleeve from longitudinal displacement relative to the mandrel (1). The sub-assembly can reduce torque in a drill string, by reducing frictional losses between the wellbore and the rotating components in the drill string.

15 Claims, 18 Drawing Sheets

EQUIPMENT TO REDUCE TORQUE ON A DRILL STRING

This invention relates to equipment for reducing torque on a drill string during a drilling operation, and is particularly concerned with a drill string torque-reducing sub-assembly.

During drilling operations a drill bit is attached to the bottom end region of a drill string, and the drill bit is caused to rotate by rotation of the drill string which, in turn, is rotated by appropriate means on the drilling rig. The drill string hangs from the rig and is in tension but, in order to apply the necessary weight to the drill bit in order to cause it to bite into the earth, there is usually provided, just above the drill bit, a so-called bottom hole assembly which applies weight to the drill bit and is, in effect, a number of weighted drill collars.

The drill string is made up of numerous drill pipes each of which might be about thirty foot in length, the pipes being joined end-to-end. Usually the pipes are slightly enlarged in their end regions to provide for connection components to enable one end region of a drill pipe to be connected to the adjacent end region of the adjacent drill pipe.

The drill pipes are hollow and thus provide a continuous channel of communication between the drill rig and the bore, down through which a suitable drilling fluid can be introduced to the region around the drill bit.

There is an increasing move in industry to employ so-called extended reach drilling (ERD) which can mean that the drill bit can be at a position three miles laterally displaced from the foot of the rig, and there is also nowadays the use of so-called horizontal drilling wherein the bit is caused to follow an arcuate route and then drill a horizontal bore, which is a technique used to complete wells once the bits are in the reservoir. There is a particular problem associated with the transmission of power from the rig to the bit, in both extended reach drilling and in horizontal drilling. The problem is associated with rotating the string, because of the enlarged connecting end portions of the drill pipes and the associated frictional losses against the edge of the bore.

Often the bore is lined with a casing and, to protect the drill string from abrasion against the side wall of the bore or the casing, there can be employed a so-called casing or drill pipe protector. The purpose of the drill pipe protector is to keep the pipe from the casing or from the bore hole, as the case may be. There have been attempts to make protectors which are non-rotating, i.e. they may remain in fixed contact with the casing or side wall of the bore and not rotate with respect thereto, which of necessity means that the drill string must rotate with respect to the protector.

However, the prior art arrangements currently available tend to suffer from various short comings.

According to the present invention, there is provided a drill string torque-reducing sub-assembly comprising:

- a hollow longitudinally-extending mandrel capable of being coupled between adjacent first and second drill pipes in the drill string; and
- a sleeve capable of freely rotating about the mandrel, the sleeve having an external diameter intended to be larger than that of any connection component of the first or second drill pipe, and the sleeve being prevented by means mounted internally of the sleeve from longitudinal displacement relative to the mandrel.

Preferably the mandrel has first and second opposing ends, with the first end having a male connection component capable of being connected to a female connection component of a first drill pipe, and with the second end having a female connection component capable of being connected to a male connection component of a second drill pipe.

To assist in the relatively free rotation between the sleeve and the mandrel, the sub-assembly preferably comprises two spaced-apart ball races, each of which serves various important functions indicated in more detail below.

Depending on the particular operating conditions anticipated, more than one of the sub-assemblies according to the present invention could be, and is likely to be, required over the total length of the drill string; in fact, as with the drill pipe protectors, the sub-assemblies could be used in multiples.

The sleeve, whilst not necessarily being cylindrical in the strict mathematical sense of the word, can conveniently be formed from two half-sleeves which are generally semi-cylindrical in form (although not strictly semi-cylindrical in the true mathematical sense). The half-sleeves are provided with means for securing the two half-sleeves to each other securely around the mandrel and are preferably also provided with means to ensure proper alignment between the two half sleeves, which is important from the point of view of ensuring that the ball races are uniformly provided circumferentially around the mandrel at the two spaced-apart locations.

To assist longitudinal movement of the sleeve relative to the casing or the side wall of the bore as the drill bit and drill string are advanced along the bore, with corresponding advancement of the mandrel and sleeve, the sleeve preferably has a generally smooth exterior.

However, to enhance free longitudinal movement of the sleeve relative to the internal surface of the casing or of the side wall of the bore, the sleeve may carry in the region of its so-called blades suitable means for reducing resistance to such longitudinal movement. Examples of such friction-reducing means are captive bearings in the blades, with only part of the bearings exposed, as well as wheels, mounted in the blades with part of the wheels exposed to contact the internal surface of the casing or the side wall of the bore.

In longitudinally extending regions between the blades of the sleeve are recessed regions which are conventional and which provide channels through which material being expelled upwardly along the bore in the direction from the drill bit to the rig, may pass.

As indicated above, the sub-assembly in accordance with the present invention preferably has only two spaced-apart ball races, which can be regarded as regions of support between the sleeve and the mandrel. There is preferably a wide gap between the mandrel and sleeve, the gap being bridged only by the two sets of ball bearings. It is this provision of two spaced-apart support regions and the provision of the wide gap between the mandrel and the sleeve which allows the lengthy mandrel to flex whilst still being fully rotatable with respect to the sleeve, thus avoiding any binding between the mandrel and the sleeve, even if the sleeve is being held against any rotation (with the mandrel) by the internal surface of the casing or the side wall of the bore.

Such a bearing arrangement of the type preferably employed in the sub-assembly of the present invention can satisfactorily achieve four functions, namely:- it can prevent any longitudinal movement of the sleeve relative to the mandrel, it is able to transmit axial thrust, it is able to transmit radial forces, and it can provide the aforementioned wide gap.

Whilst much lubrication might be important in the region of the drilling bit, it is not necessary in the region of the sub-assembly in order to provide freedom of rotation between the sleeve and mandrel; instead such free rotation is provided by the aforementioned ball race arrangements. If desired, with regard to lubrication, seals could be provided either side of the bearings.

In order to reduce significantly the possibility of any nuts or bolts, which are used to secure the two half-sleeves together, from becoming loose during the drilling operations which are often accompanied by considerable vibration, it is preferred that when the nuts and bolts have been "torqued up" suitable plugs are then introduced into the holes in which the bolt head and/or nuts are located, to stop them from shaking loose with vibration.

Those regions defining the race ways can be conveniently formed as part of the mandrel and/or sleeve, or they can be preformed and secured in the correct position.

As will be appreciated, the provision of two spaced-apart race ways enables point contact to be made at each race way, particularly during flexing of the mandrel, as opposed to line contact, which is present in some of the prior art arrangements. The sub-assembly of the present invention is able to absorb high side forces during the drilling of the wellbore (such forces being typically experienced in extended reached applications where high torque is normally generated due to contact between the drill string and the side wall).

The provision of means mounted internally of the sleeve for preventing longitudinal displacement of the sleeve relative to the mandrel is simple and has advantages over prior art arrangements in which external means are provided to prevent any unnecessary longitudinal movement between the component equivalent to the sleeve of the present invention and any prior art component equivalent to the mandrel of the present invention.

As parts of the sleeve are of greater diameter than the mandrel and are also intended to be of greater diameter than even the enlarged end regions of any drill pipes, there is the danger that the leading edge of the sleeve might become snagged on any projections in the casing or the side wall of the bore. With a view to reducing this, the sub-assembly preferably also includes shrunk-on rings which are shrunk onto the mandrel and which are of sufficient diameter externally to protect the leading end regions of the sleeve. Moreover, the shrunk-on rings can also serve as an additional security means which, in the event of failure of the nuts and bolts securing the two half-sleeves together, can prevent the two half-sleeves from parting completely, thus ensuring that the total sub-assembly can be retrieved as a unit.

In order to provide increased durability, it is preferable that at least the mandrel, and preferably also the sleeve, is hardened in the region of the ball races. However, a hardened mandrel is more resistant to flexing and is likely to result in cracking during flexing. For this reason the hardening in the mandrel is preferably limited to the regions adjacent the ball races, with the rest of the mandrel being left in unhardened form, to allow the ends of the mandrel to flex freely relative to its midpoint without compromising or inhibiting the ability of the mandrel to rotate freely within the stationary sleeve. If desired, part of the mandrel may have adjacent the ball race a region having a second radius, which will be explained in more detail in the specific description relating to the embodiments illustrated in the accompanying drawings.

Different intended operational conditions will cause different strains to be put upon the torque-reducing sub-assembly. It is with a view to taking account of such factors that alternative arrangements, compared to the two spaced-apart ball bearing races alone, can be employed.

In a first alternative, in addition to the two spaced-apart ball bearing races, there are two roller races located slightly inboard of the ball-bearing races. The rollers can be standard rollers used for bearing purposes. Preferably, in such an arrangement, the overall clearance between the mandrel and the sleeve is greater in the region of the rollers than in the region of the ball bearing races, in order still to allow the mandrel to be able to flex relative to the sleeve.

In a second alternative, instead of having two spaced-apart ball bearing races, there can be a single, centrally located, ball bearing race alone, or one ball bearing race with a set of rollers on each side.

As further alternatives, instead of, or in addition to, the sets of rollers used in conjunction with the two ball bearing races or the single ball bearing race, there can be employed tungsten carbide coatings or ceramic inserts provided on the mandrel or the sleeve (in conjunction with the ball bearing race(s)), to provide extra radial support.

Instead of the sleeve being formed from two half-sleeves, as contemplated above, it could be formed as a single component, in which case the internal diameter of the sleeve would need to exceed the external diameter of at least much of the mandrel. It may not be necessary for the internal diameter of the single component sleeve to be greater than the external diameter along the complete length of the mandrel, as the sleeve could be slipped over the mandrel always from the same end of the latter.

Where a single component sleeve is used, it may be necessary to introduce the balls into the or each ball bearing race through a port in the sleeve, after which the port is then capped with an appropriate retaining cap to prevent release of the balls.

With regard to the location of any rollers which are present, when a split-sleeve (i.e. a sleeve formed form two half-sleeves) is used the rollers can be located in grooves in the sleeve. Where, however, a single component sleeve is used, dimensional constraints may require the rollers to be accommodated in grooves in the mandrel.

If desired, steps can be taken to provide seals to minimise the invasion of drilling fluid into the bearing area, as it is felt that this will help with the longevity of the sub-assembly and increase the service interval.

For a better understanding of the present invention, and to show how the same may be carried into effect, reference will now be made, by way of example, to the accompanying drawings, in which.

Figure 1:
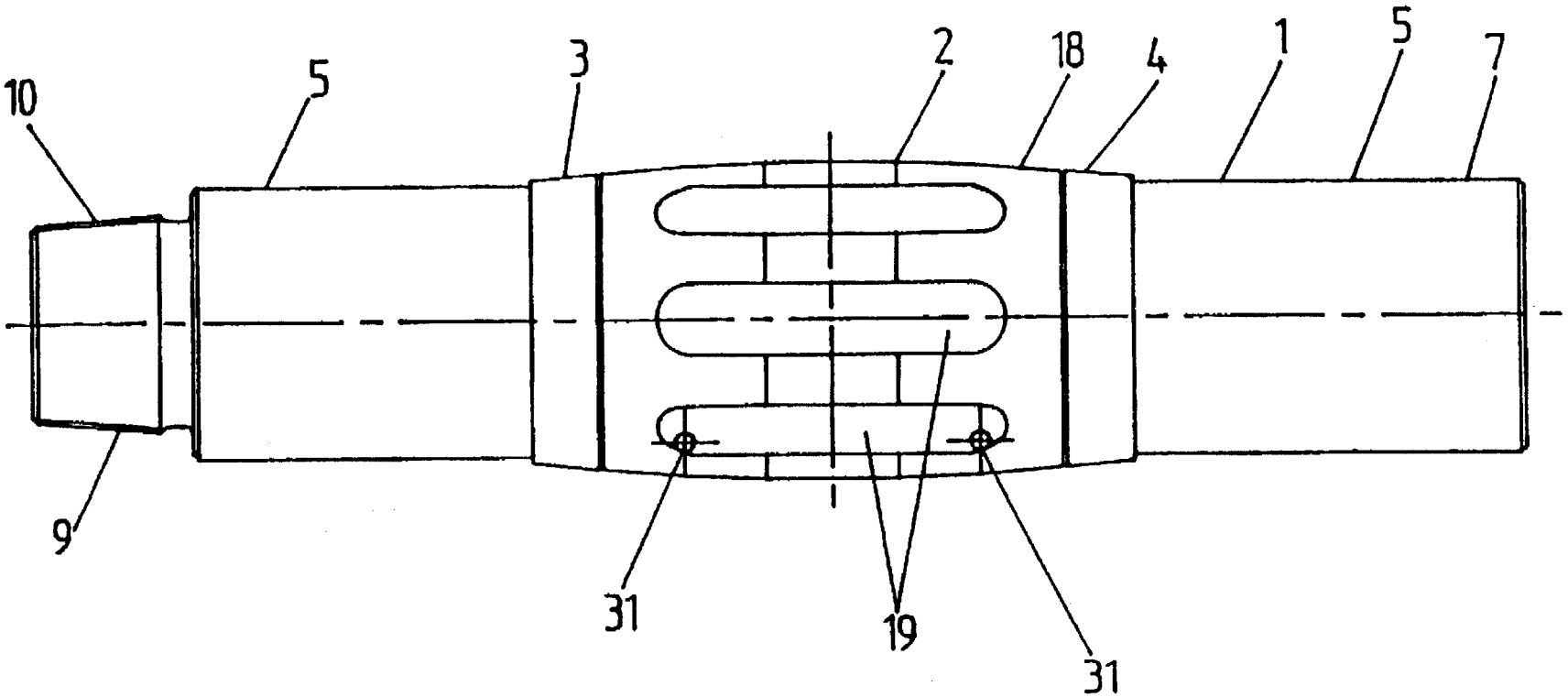
FIG. 1 is a side view of a first embodiment of sub-assembly in accordance with the present invention, comprising a mandrel, a sleeve rotatable on the mandrel, and two rings.

Referring firstly to FIGS. 1 to 4, the illustrated sub-assembly is made of four major components, namely a mandrel 1, a sleeve 2 rotatably mounted on the mandrel 1 and first and second rings 3 and 4. Other important components are present and these will be described in more detail in due course.

The mandrel 1 has over much of its exterior a main cylindrical external surface 5, and has over much of its interior a cylindrical internal surface 6. One end region 7 of the mandrel 1 is provided with a tapering internal surface 8 which tapers inwardly in the direction of the central point of the mandrel and is intended to serve as a female connection component intended to receive a complementary male component (not shown) of an adjacent drill pipe forming part of the drill string, and for this purpose the tapering internal surface 8 is provided with an internal screwthread.

At the opposite end region 9 of the mandrel 1 the exterior tapers in a direction away from the centre of the mandrel and this tapered region 10 is provided with an external screwthread and is intended to serve as a male connection component intended to be connected to a complementary female component of an adjacent drill pipe forming part of the drill string.

The central region 11 of the mandrel has a cylindrical external surface which has a diameter less than that of the main cylindrical external surface 5. On each side of the central cylindrical region 11 the external surface of the mandrel has the following regions, in the following order moving away from the central region or hub 11, namely: a concave region or groove 12 which is to serve as part of the ball race (described in detail later), a generally cylindrical region or leg 13 of less diameter externally than the central region 11, the cylindrical region 13 leading into a gently curving region 14 of increasing external diameter, which terminates in a radial face 15 which at its outer point joins at right angles the main cylindrical external surface 5.

As is clearly shown in FIG. 1, located adjacent, and partially accommodated within, the concave regions 12 are ball bearings 16 which assist in the free rotation of the sleeve 2 about the mandrel 1. The additional functions of the ball bearings 16 will be described in more detail later.

Figure 2:
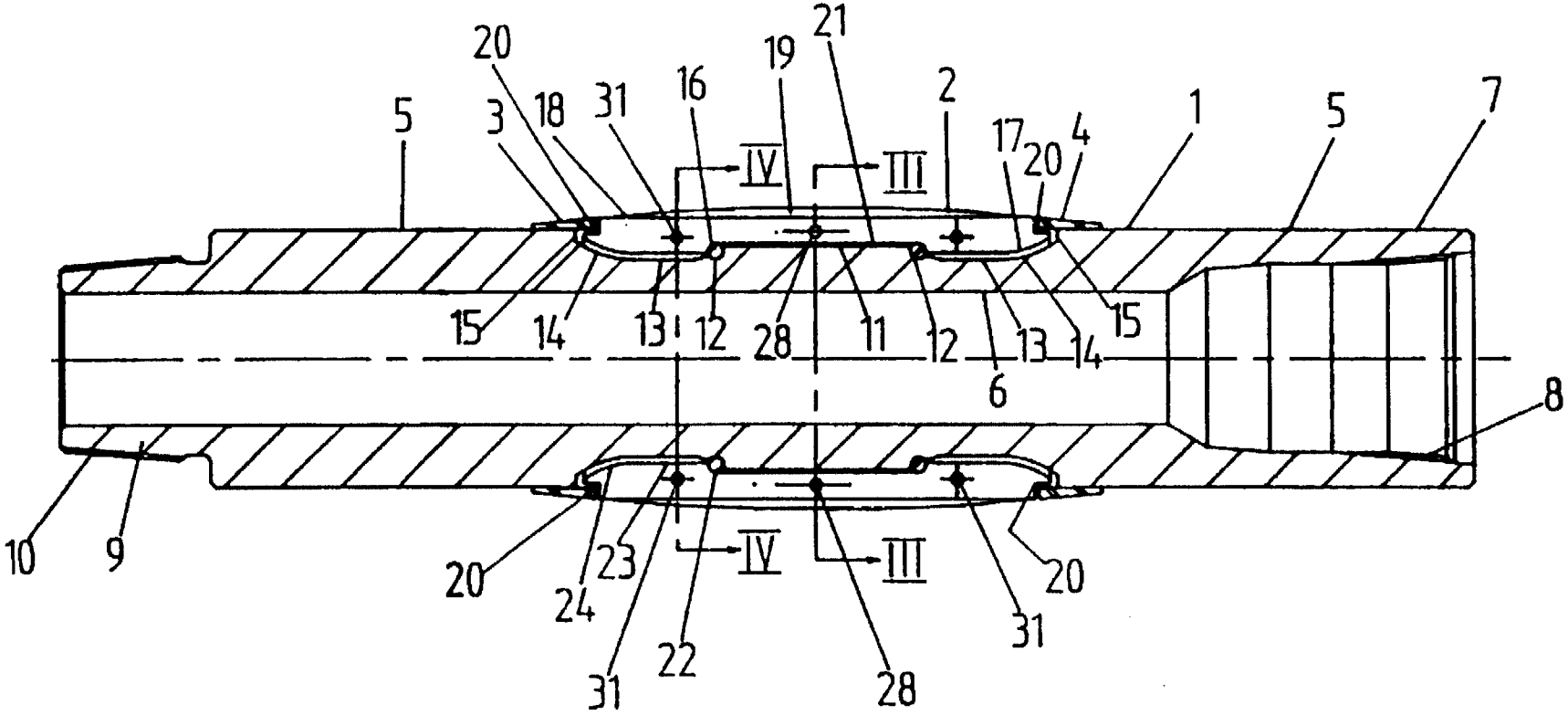
FIG. 2 is an longitudinal section through the sub-assembly of FIG. 1, taken along the line II—II in FIG. 3.
Figure 3:
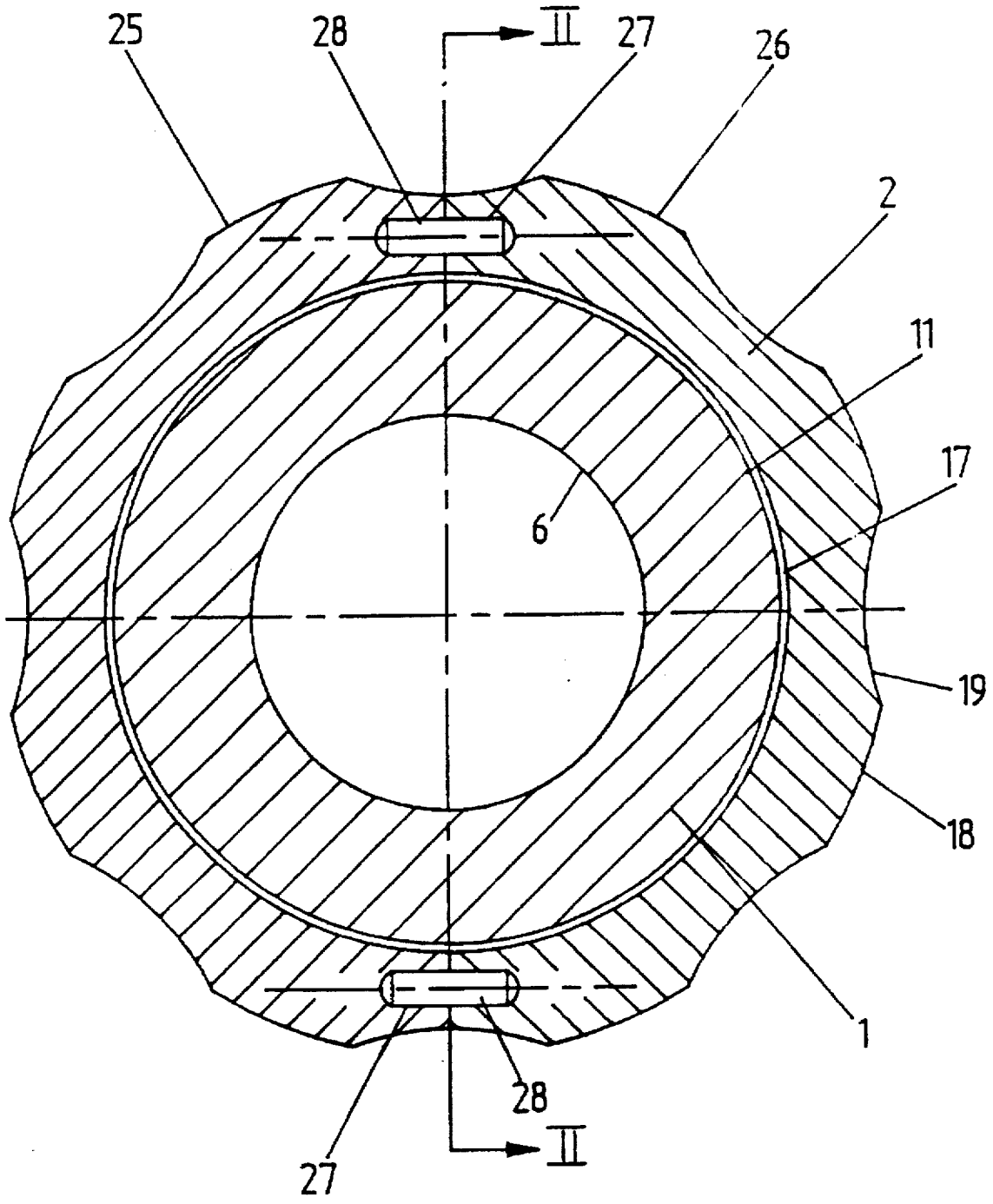
FIG. 3 is a cross-section through the sub-assembly of FIG. 1, taken at the central point, along the line III—III in FIG. 2.
Figure 4:
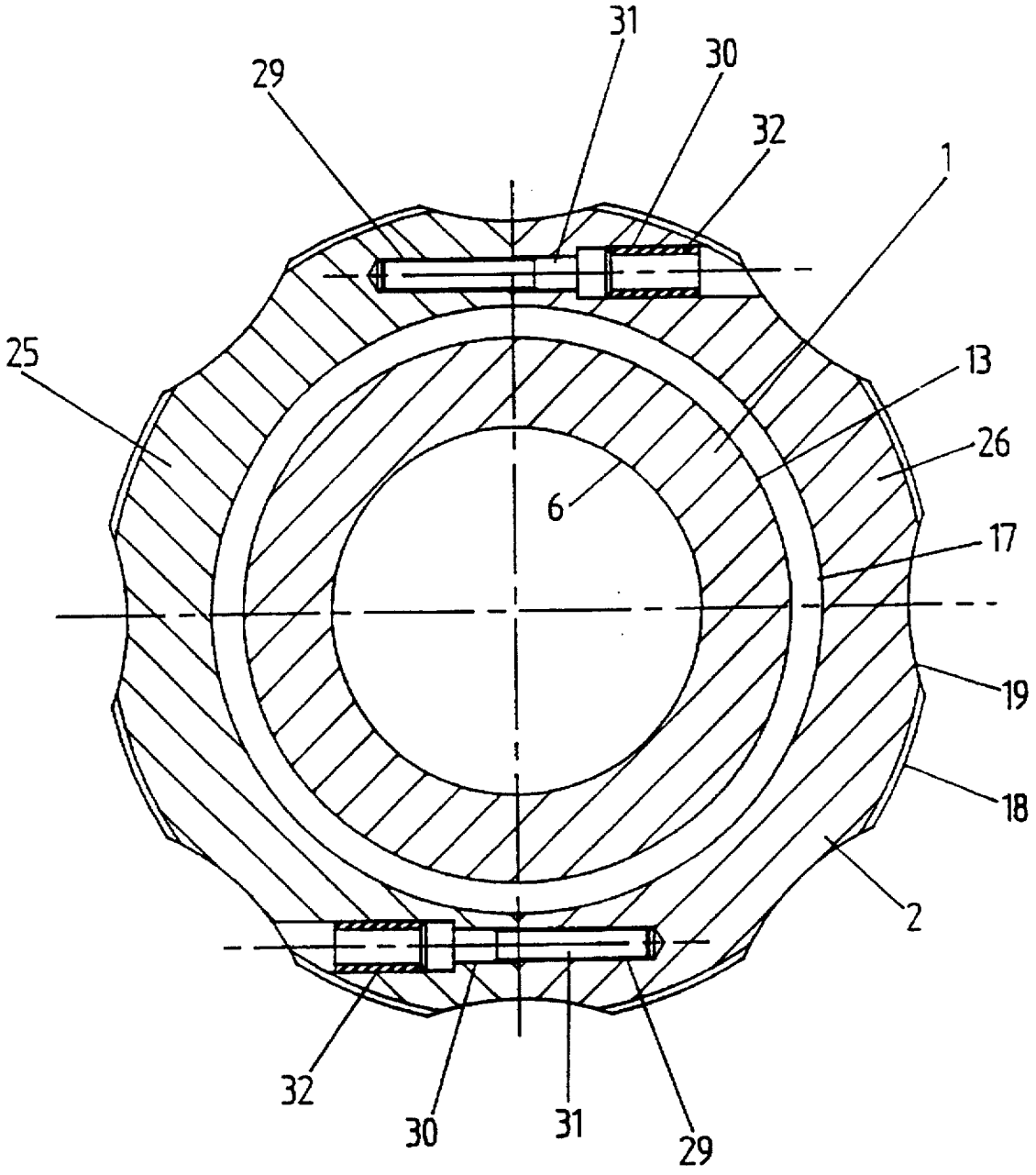
FIG. 4 is a cross-section through the sub-assembly of FIG. 1, taken at a different point, in fact along the line IV—IV in FIG. 2.
Figure 5:
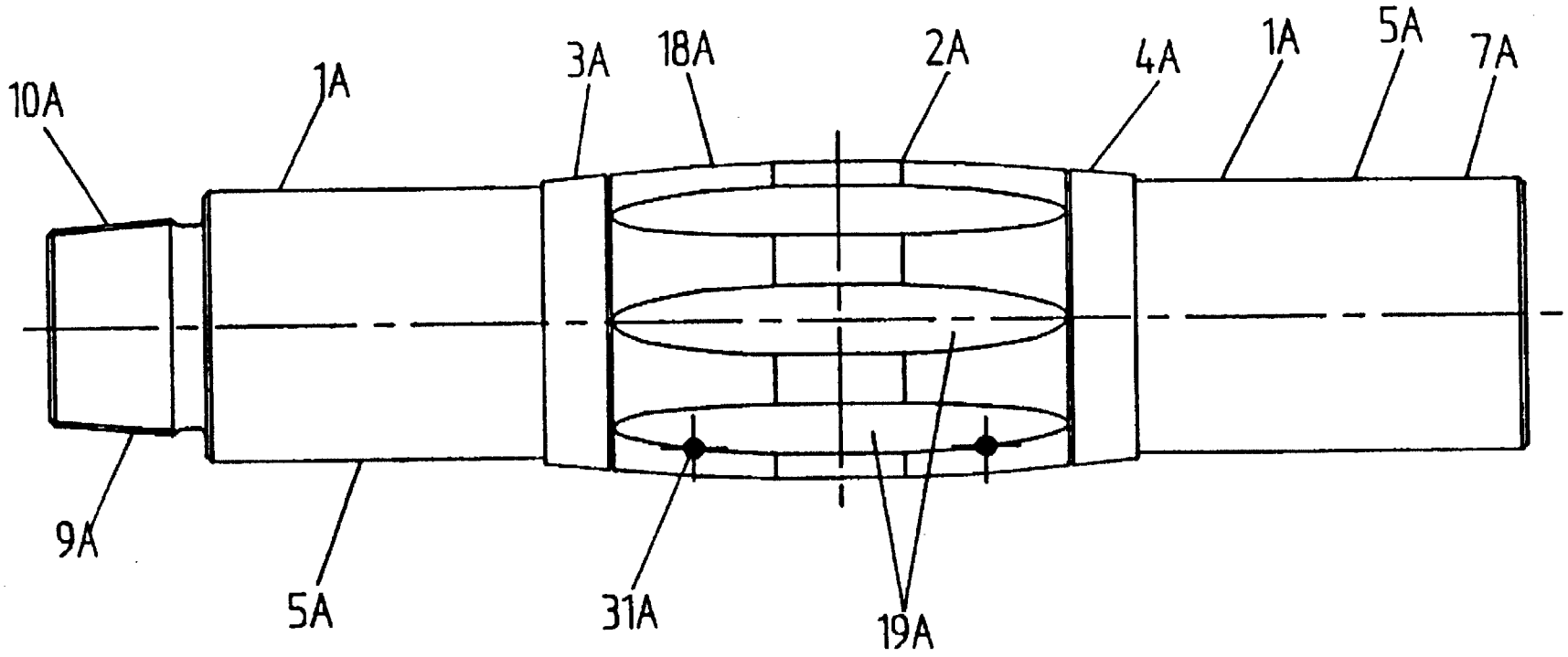
FIG. 5 is a side view of a second embodiment of sub-assembly in accordance with the present invention.

For the avoidance of doubt, the mandrel is rotationally symmetrical about its central longitudinal axis and therefore the description of the external surface of the mandrel 1 and the reference numerals in the upper part of FIG. 2 are applicable to the components illustrated in the lower part of FIG. 2.

The sleeve 2 can be thought of as generally circular in cross-section at any point along its axis in that, at any point it has a circular internal surface 17 and a generally circular external surface 18 apart from longitudinally extending recesses 19.

With regard to the external surface 18 of the sleeve 2, the external diameter increases in going from each end region of the sleeve towards the centre, except in the region of the recesses 19. Also, the opposing end regions 20 of the sleeve 2 are stepped, and the purpose of the stepping will be described later.

With regard to the internal surface 17 of the sleeve 2, the diameter is different at different locations. Thus, in a central region 21 of the sleeve 2 the internal diameter remains constant and is slightly larger than the external diameter of the opposing central region 11 of the mandrel 1. Still with regard to the internal surface 17 of the sleeve 2, at the opposite ends of the central region 21 there is provided a concave region of progressively decreasing diameter 22 which is concave and forms an opposing part of the ball race, opposite the concave region 12 of the mandrel 1. The concave region 22 leads to a generally cylindrical region 23, which is situated opposite, and spaced from, the cylindrical region 13 of the mandrel 1. The cylindrical region 23 of the sleeve 2 then leads into a curved region 24 having a diameter which increases towards the end regions of the sleeve 2, and terminates in the stepped region 20 of the sleeve 2.

The sleeve 2 is formed from two half-sleeves 25 and 26 which are identical and which, when properly located side by side, make up the sleeve 2. In order to assist in the proper location of the two half sleeves 25 and 26 relative to each other, each half sleeve is provided at its central point with two bores 27 opposite the bores in the other half sleeve, and dowels 28 are located in the bores 27 for location purposes.

In addition, each half sleeve has at locations spaced apart from the mid-point of the half sleeve two internally threaded bores 29 and two stepped bores 30, the bores 30 in one half sleeve being located opposite the bores 29 in the other half sleeve. Located in the bores 29 and 30 are bolts 31 which are tightened into position to secure the two half sleeves together. To prevent accidental removal of the bolts 31, shrunk-in sleeves 32 are fitted in the larger free end regions of the stepped bores 30.

Although not clear from FIGS. 1 to 4, the mandrel 1 is formed of a generally flexible alloy steel material which is hardened but only in the regions adjacent the concave regions which form part of the ball races, for durability. As a hardened material is more prone to cracking during flexing, the hardening is present only adjacent concave regions 12. The ball bearings 16 in the ball races serve several functions. They serve to enable free rotation relatively between the mandrel 1 and the sleeve 2; in addition, when the mandrel 1 flexes in use, the ball bearings serve as point contacts rather than line contacts, which reduces frictional loses during transmission of power; also, the ball bearing 16 serve to space the sleeve 2 from the mandrel 1 so that when the ends 7 and 9 of the mandrel 1 flex with respect to the mid point of the mandrel 1, there is no direct contact between the mandrel 1 and the sleeve 2.

The shrunk-on first and second rings 3 and 4 serve to protect the leading edge of the sleeve 2 during its movement through any component disposed outside the sleeve 2. Also, as indicated earlier, in the event of any failure of the bolts 31, the shrunk-on first and second rings 3 and 4 would help to keep the two half sleeves 25 and 26 close to each other, which would enable the whole sub-assembly to be removed from the wellbore as a single unit.

Half sleeves 25 and 26 can be positioned and secured around the mandrel 1, with the ball bearings 16 in their respective ball races with the first and second rings 3 and 4 being shrunk-on to the mandrel in the positions shown most clearly in FIG. 2.

The dimensions of the various components of the sub-assembly will be determined by the dimensions of the pipe lengths to which the sub-assembly is to be secured.

With regard to the gap in between the mandrel 1 and the sleeve 2 in the embodiment of FIGS. 1 to 4, it can be appreciated that in the zone of the central region 11 of the mandrel 1 the gap between that central region 11 and the opposing central region 21 of the sleeve 2 is relatively small compared with the gap between the region 13 of the mandrel 1 and the region 23 of the sleeve 2. This is because, when the mandrel 1 flexes, the larger gap is required in order to accommodate the greater movement due to the flexing.

Turning now to the embodiment illustrated in FIGS. 5 to 12 of the drawings, in many respects the components illustrated therein are comparable or identical the corresponding components illustrated in the embodiment shown in FIGS. 1 to 4 of the drawings. Corresponding components are indicated in the embodiment of FIGS. 5 to 12 by similar reference numerals as employed on the corresponding components of the embodiment of FIGS. 1 to 4, except that in FIGS. 5 to 12 the reference numerals are followed by the letter "A".

The sleeve 2A in the embodiment of FIGS. 5 to 12 differs from the sleeve 2 of the embodiment of FIGS. 1 to 4 in that generally speaking the exterior, as seen in side view, is less arcuate and instead takes the shape of a central flat between two tapering portions. Also, the recesses 19A as most clearly shown in FIG. 5 extend over a greater length and are differently shaped from the recesses 19 of FIG. 1.

Figure 6:
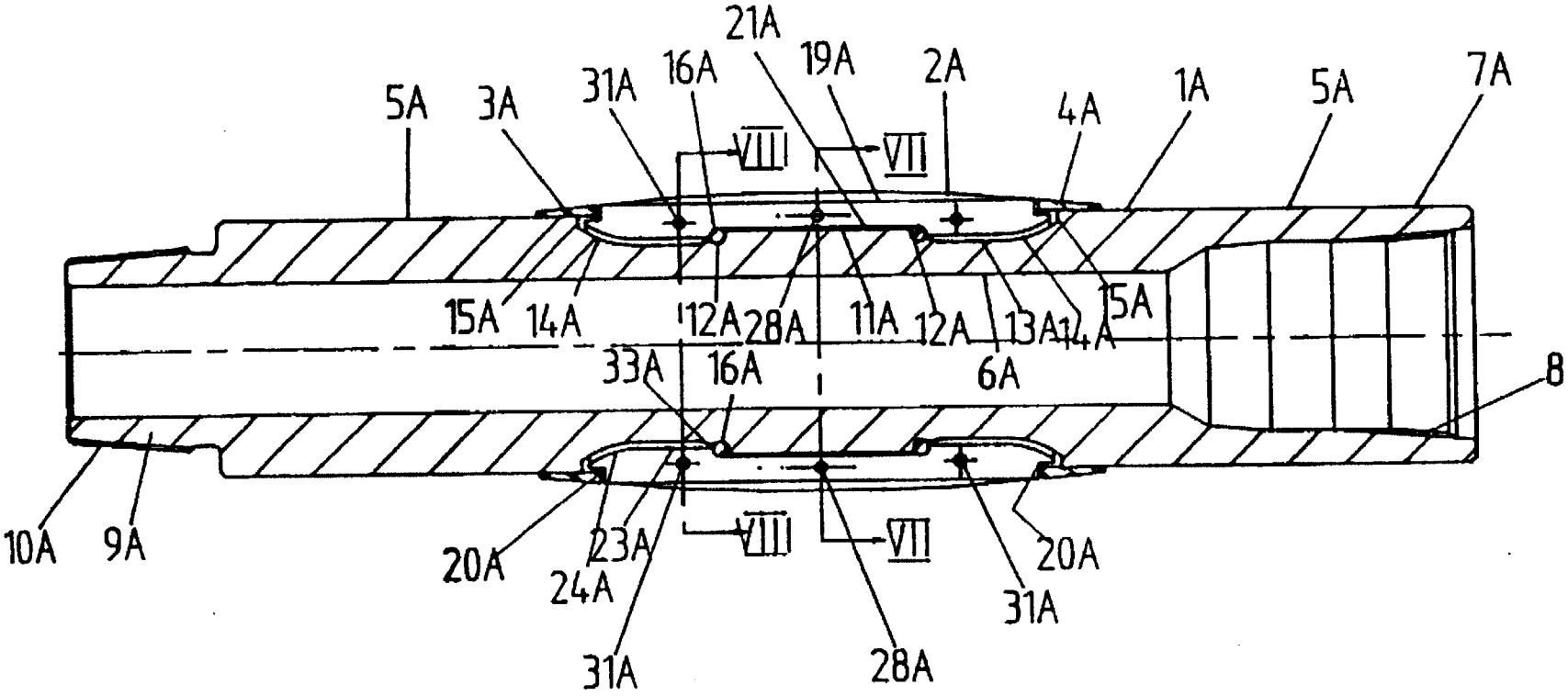
FIG. 6 is a longitudinal section through the sub-assembly of FIG. 5, corresponding to the view taken on the line VI—VI in FIG. 7.
Figure 7:
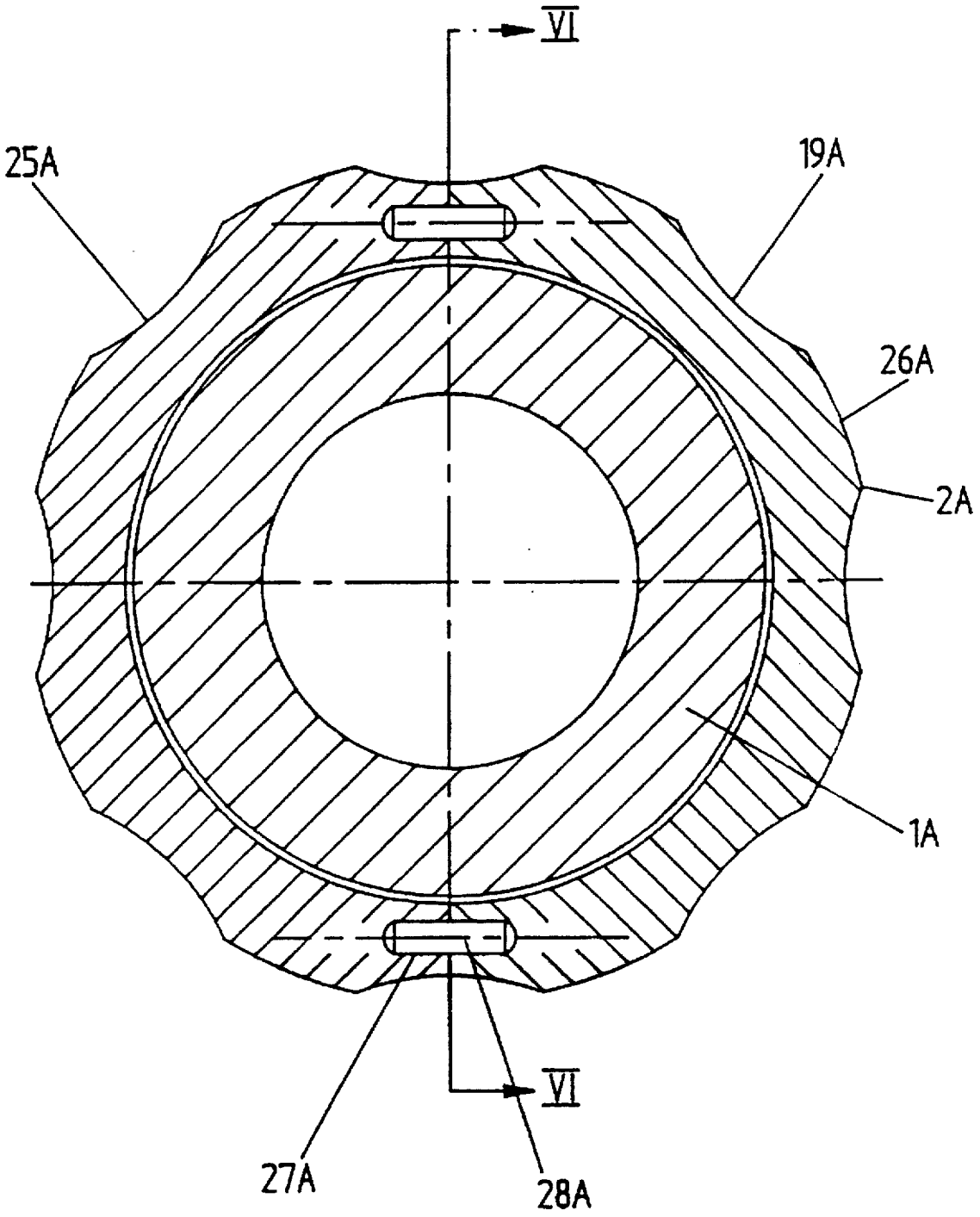
FIG. 7 is a cross-section through the sub-assembly of FIG. 5, taken at the central point, along the line VII—VII in FIG. 6.
Figure 8:
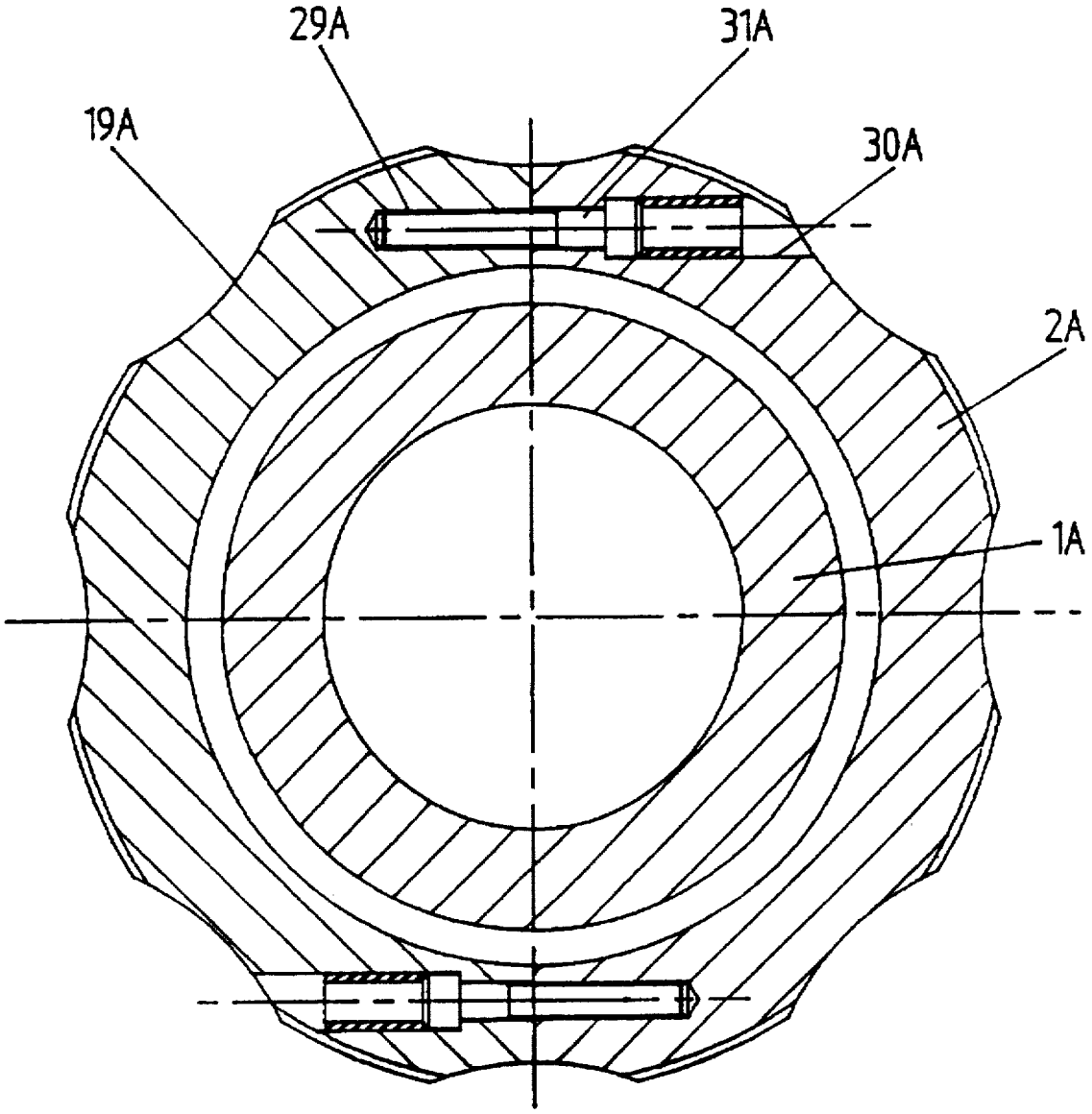
FIG. 8 is a cross-section through the sub-assembly of FIG. 5, taken at a different point, in fact along the line VIII—VIII in FIG. 6.
Figure 9:
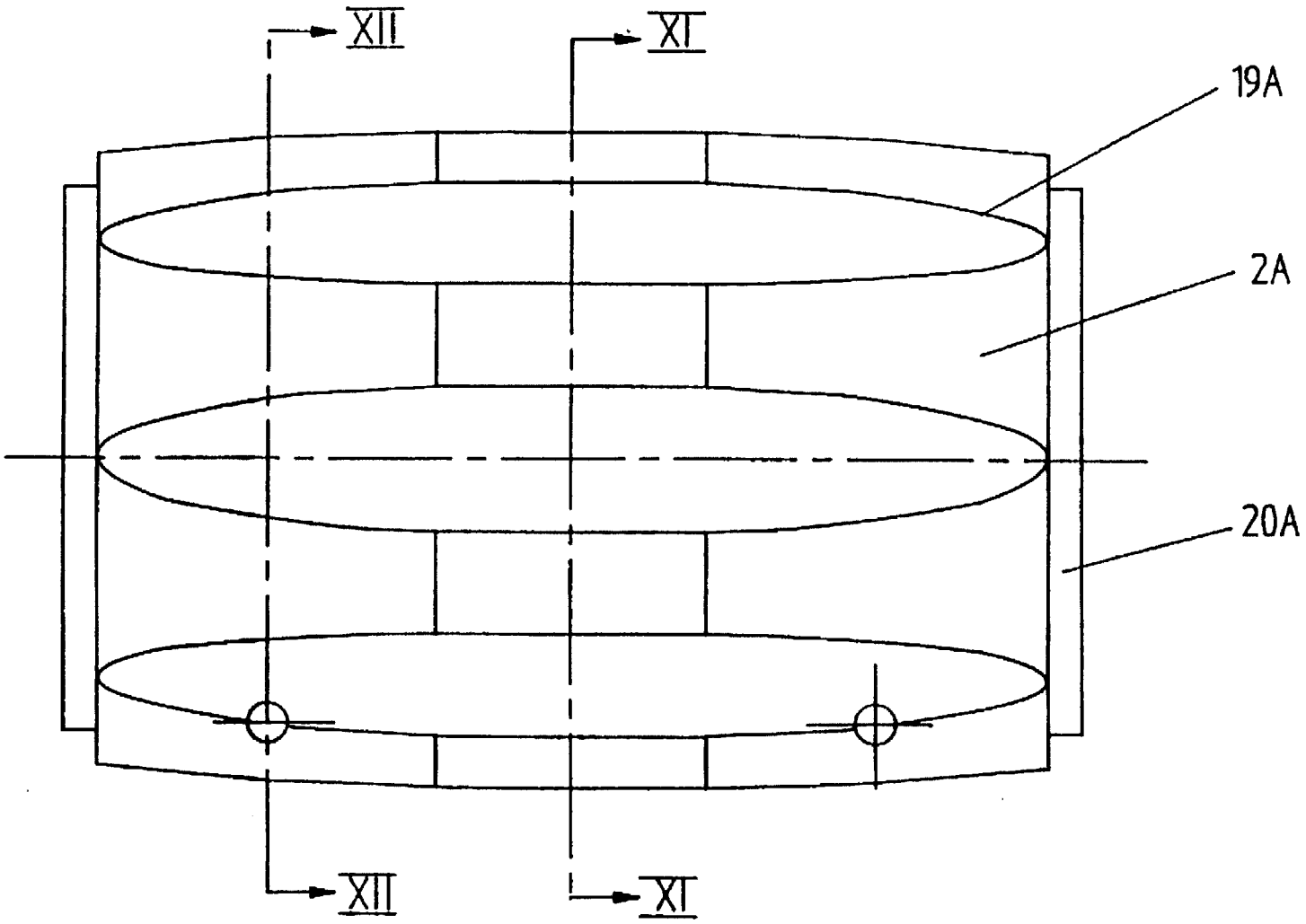
FIG. 9 is a side view of the sleeve which forms part of the sub-assembly of FIG. 5.
Figure 10:
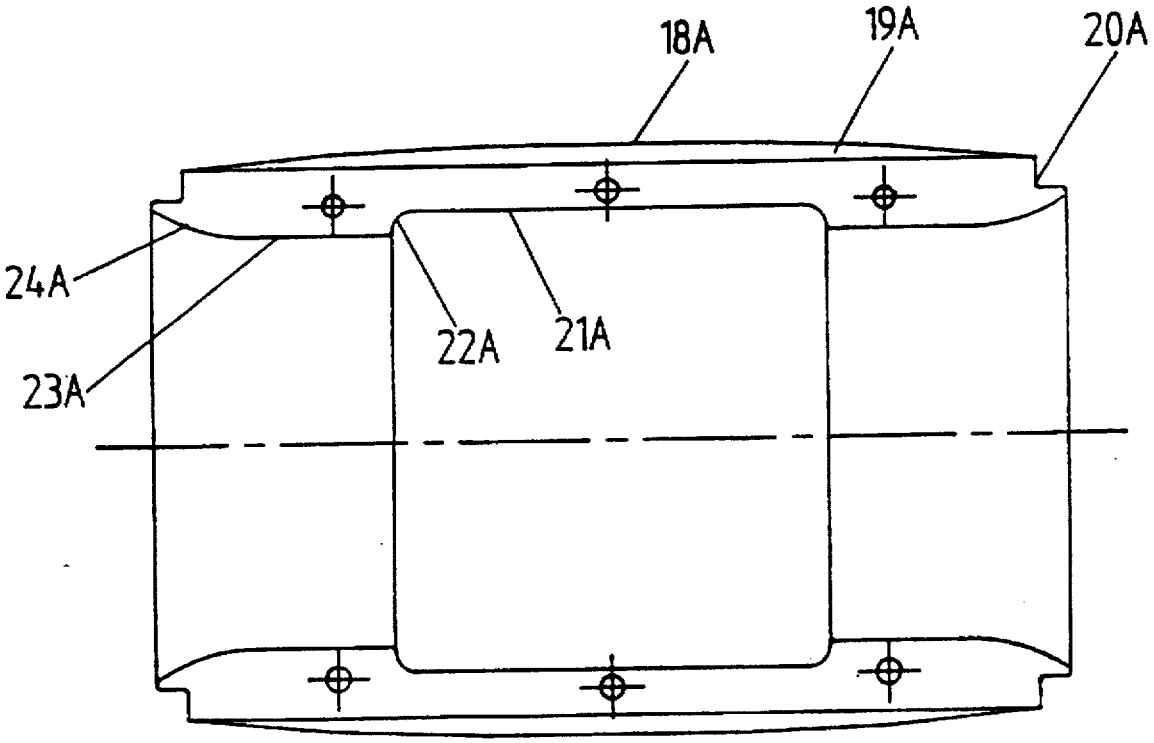
FIG. 10 is a vertical longitudinal section through the sleeve of FIG. 9.
Figure 11:
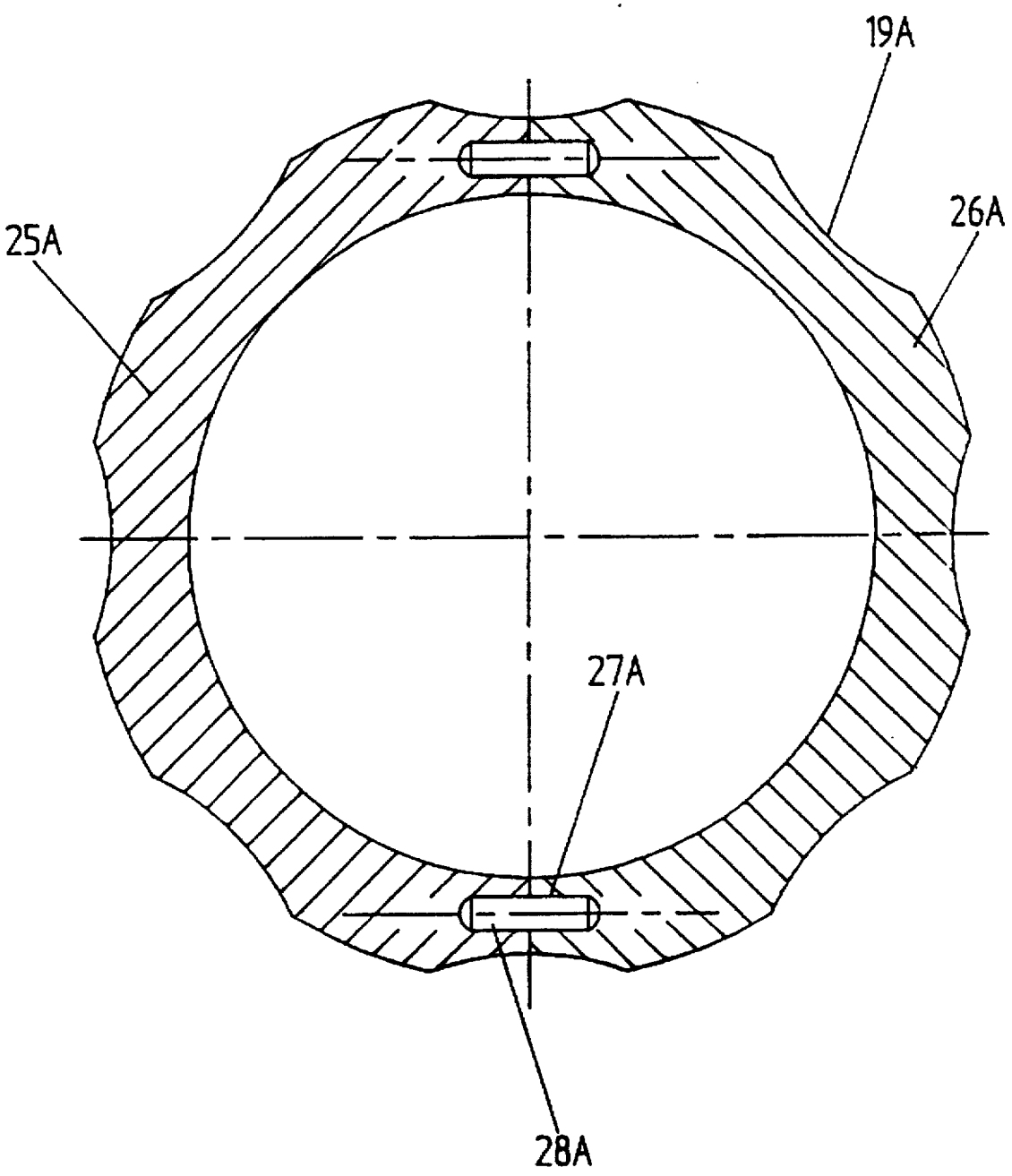
FIG. 11 is a cross-section through the sleeve of FIG. 9 taken at the central point, along the line XI—XI in FIG. 9.
Figure 12:
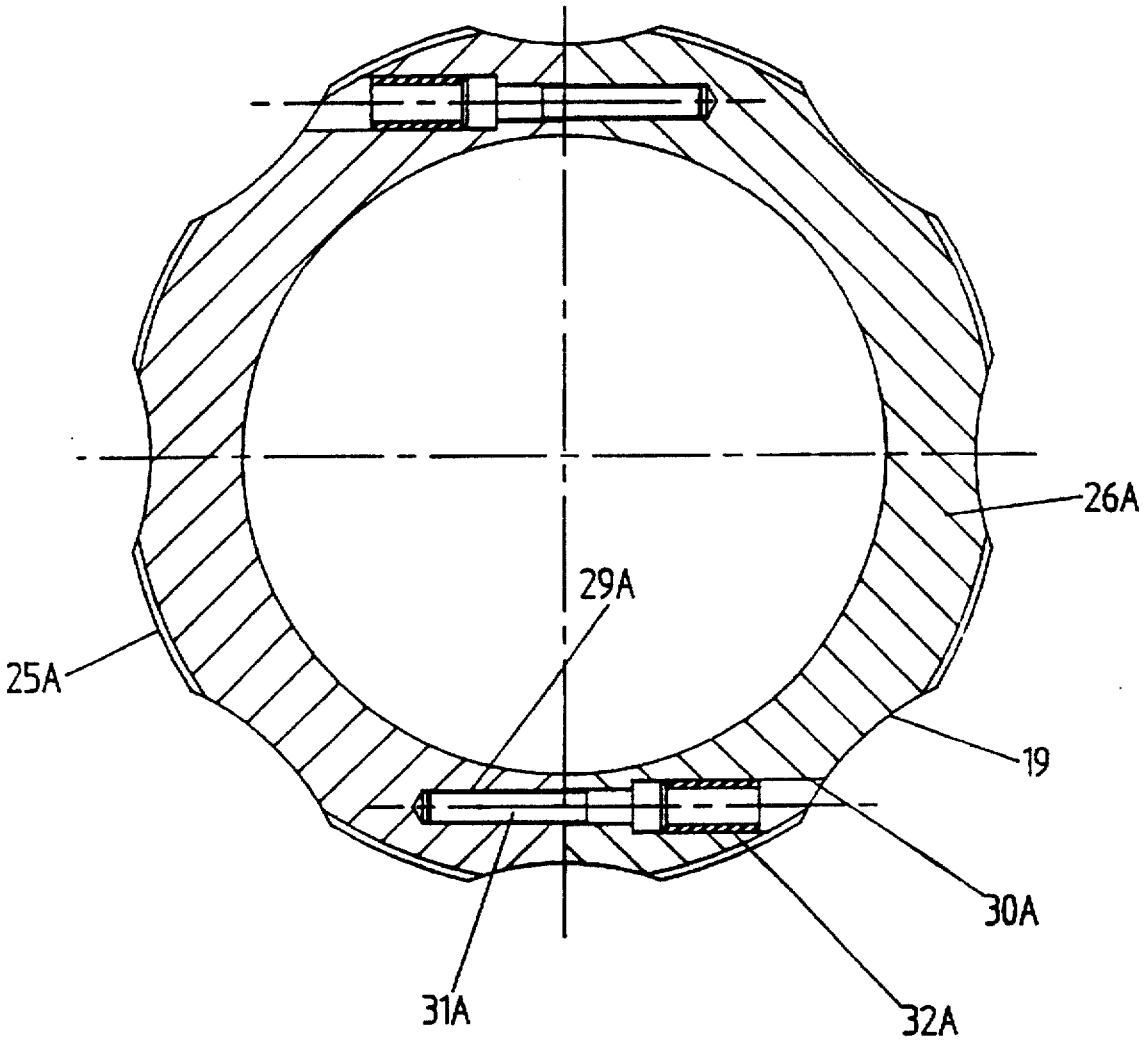
FIG. 12 is a cross-section through the sleeve of FIG. 9 taken at a different point, in fact along the line XII—XII in FIG. 9.

Many of the features relating to the external contour of the mandrel 1A and the internal contour of the sleeve 2A in the embodiment of FIGS. 5 to 12 correspond substantially to those of the external contour of the mandrel 1 and the internal contour of the sleeve 2 of the embodiment of FIGS. 1 to 4, but particular attention is drawn to the additional shoulder 33A, which is shown most clearly in FIG. 6, and which is intermediate the cylindrical region 13A and the concave region 12A on the external surface of the mandrel 1A. The holder 33A can also be hardened, as is the zone surrounding the concave region 12A.

The ball bearings 16A in the embodiment of FIGS. 5 to 12 serve the same function as indicated for the ball bearing 16 in the embodiment FIGS. 1 to 4. As with the ball bearings 16, they also provide for the transmission of axial thrust as well as for radial thrust.

The sleeve 2A in the embodiment of FIGS. 5 to 12 is made up of two half sleeves 25A and 26A and these are located and secured by means corresponding to those indicated for the half sleeves 25 and 26 in the embodiment of FIGS. 1 to 4.

Apart form the slight difference in dimensions and the provisions of the shoulders 33A, the sub-assembly of FIGS. 5 to 12 is similar in most respects to the sub-assembly of FIGS. 1 to 4.

The sleeve 2 of the sub-assembly of FIGS. 5 to 12 is shown separately in FIGS. 9 to 12.

Figure 13:
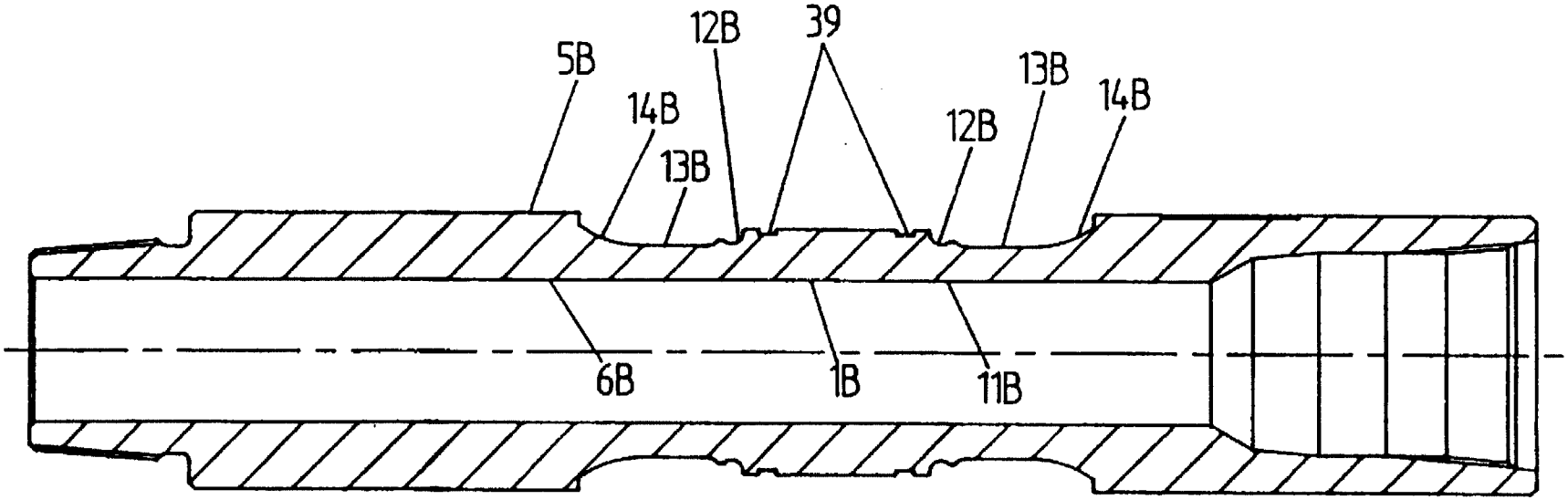
FIG. 13 is a longitudinal section through the central region of a mandrel of a third embodiment of sub-assembly in accordance with the present invention.
Figure 14:
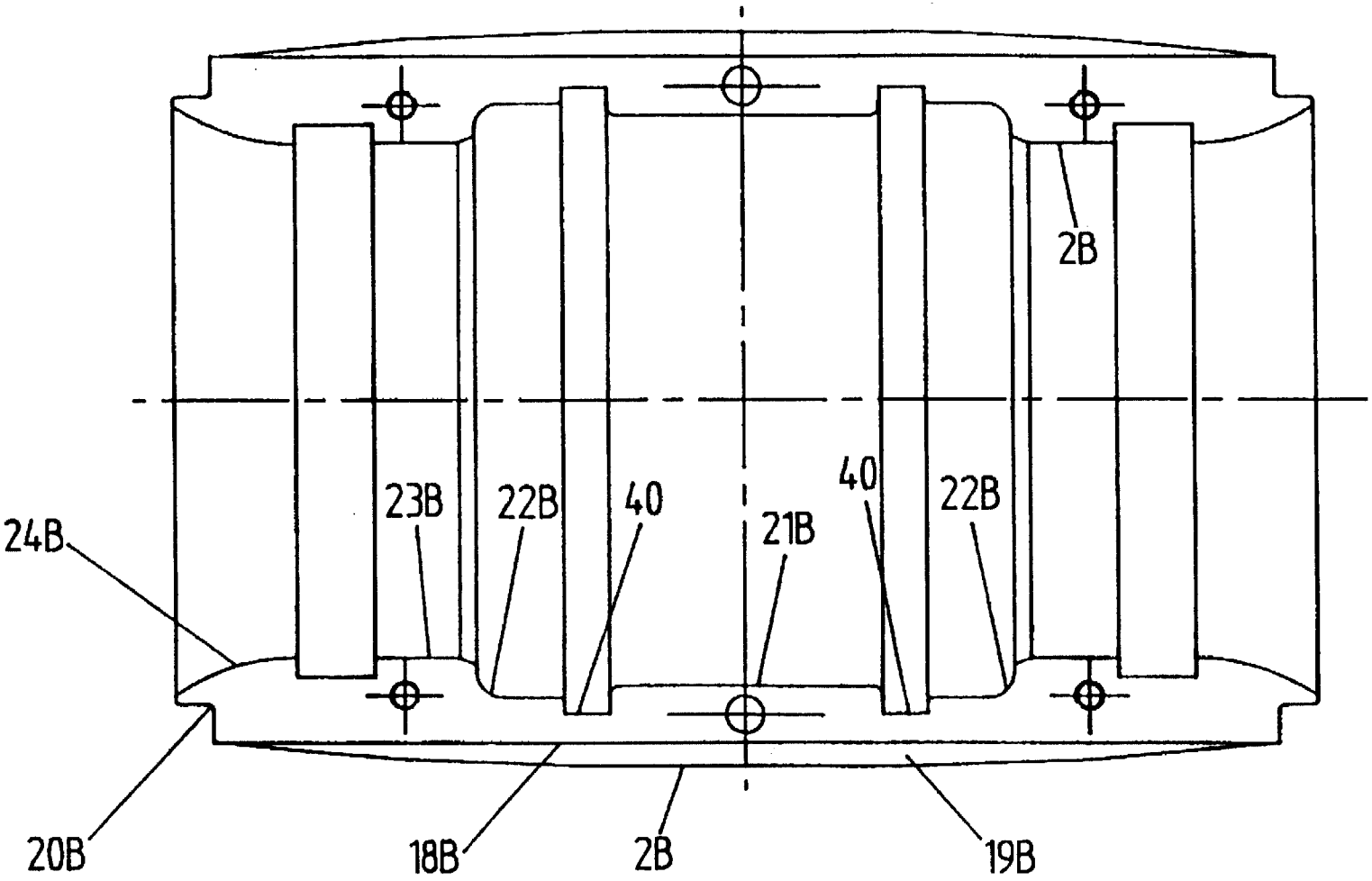
FIG. 14 is a longitudinal section through a sleeve of the same third embodiment of sub-assembly, as that in which the mandrel is shown in FIG. 13.
Figure 15:
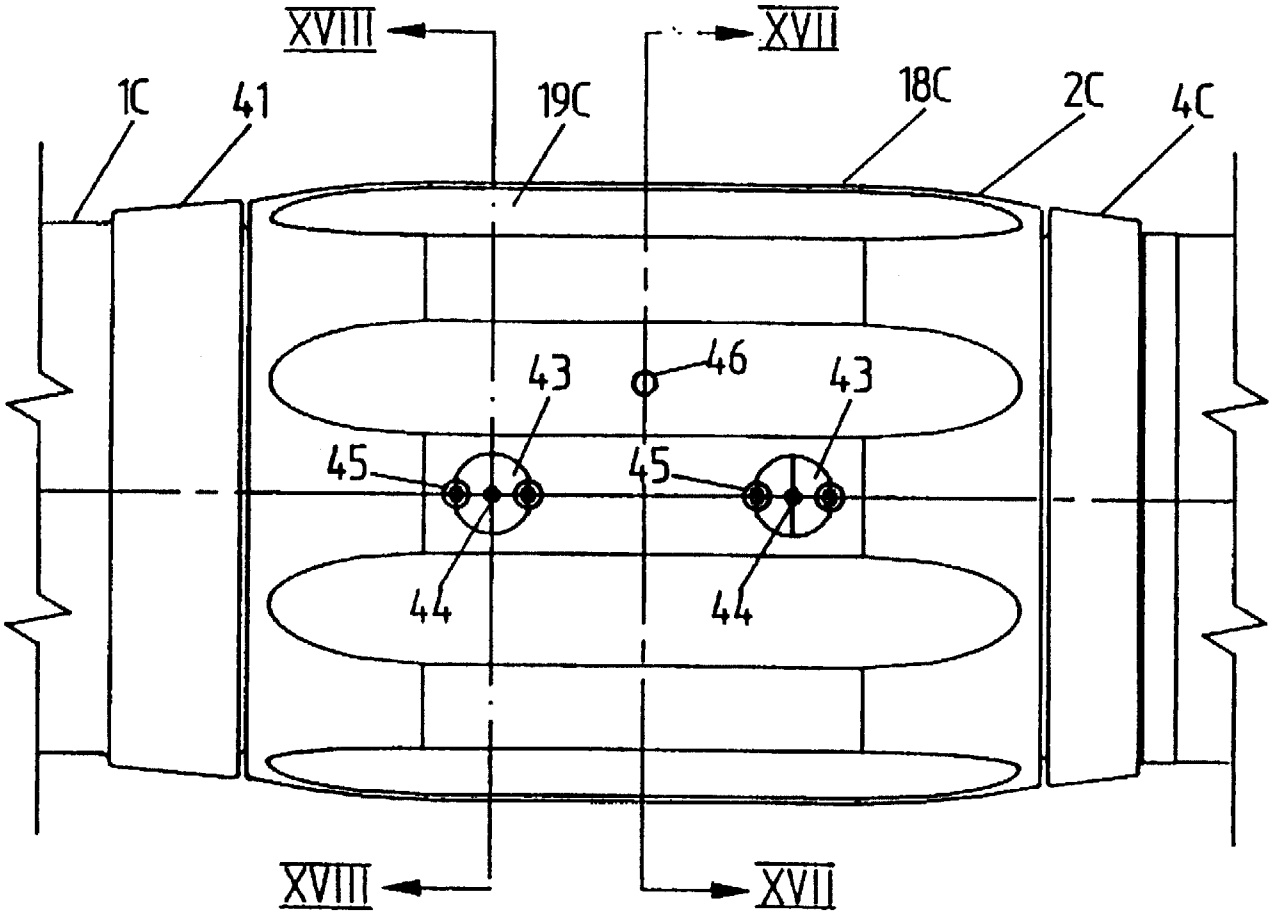
FIG. 15 is a view from above of a central region of a fourth embodiment of sub-assembly in accordance with the present invention.

Turning now to the embodiment illustrated in FIGS. 13 and 14 only the central region of the mandrel is shown in FIG. 13, the opposite end regions being comparable to the corresponding regions of the embodiments shown in FIGS. 2 and 6.

To save unnecessary repetition in the description of the embodiment illustrated in FIGS. 13 and 14, those components which are similar or identical to the corresponding components of the embodiment illustrated in FIGS. 1 to 4 are indicated by the same reference numerals as those in FIGS. 1 to 4, except that in FIGS. 13 and 14 the reference numerals are followed by the letter "B".

One important difference between the embodiment illustrated in FIGS. 13 and 14 on the one hand, and the embodiment illustrated in FIGS. 1 to 4, on the other hand, is the provision in the mandrel 1B of two grooves 39, inboard of the concave regions 12B for locating the ball bearings, and, opposite the grooves 39 in the mandrel 1B, grooves 40 on the internal surface of the sleeve 2B, the pairs of grooves 39 and 40 being intended to locate roller bearings, which can be of a conventional nature. Thus, the embodiment of FIGS. 13 and 14 can be employed where additional side thrusts are anticipated so that the roller bearings (not shown, but conventional) can assist in sharing part of the side thrust, in addition to the thrust borne by the ball bearing races.

Turning now to the fourth embodiment illustrated in FIGS. 15 to 18, only a central portion of the sub-assembly is shown. Yet again, for the sake of brevity and to avoid unnecessary repetition, those components illustrated in FIGS. 15 to 18 which are identical or similar to corresponding components shown in other drawings bear the same reference numerals as indicated in the other drawings, except that in FIGS. 15 to 18 the reference numerals are followed by the letter "C".

In the first illustrated embodiment, for example as shown in FIG. 2, it can be appreciated that the ball bearings 16 are "trapped" between the mandrel 1 and the sleeve 2, but they can initially be brought into the appropriate location by virtue of the fact that the sleeve 2 is formed from two half sleeves 25 and 26 which can be moved towards the mandrel 1 from two diametrically opposed starting positions.

In contrast, however, in the arrangement illustrated in FIGS. 15 to 18 the sleeve 2C is formed as a single component, and not from two half-sleeves. This requires the provision of different arrangements for locating the ball bearings 16C in their races between the sleeve 2C and the mandrel 1C. For this purpose the sleeve 2C is provided with two ports 42 (most clearly shown in FIG. 18), one port being opposite each respective ball race. The ball bearings 16 are fed through the port 42 and, when all are present in the respective ball race, the port is sealed by a cap 43 screwed into location in the port 42 with the aid of an internal key hole 44 and then secured against further movement caused by vibration by two securing bolts 45.

Figure 16:
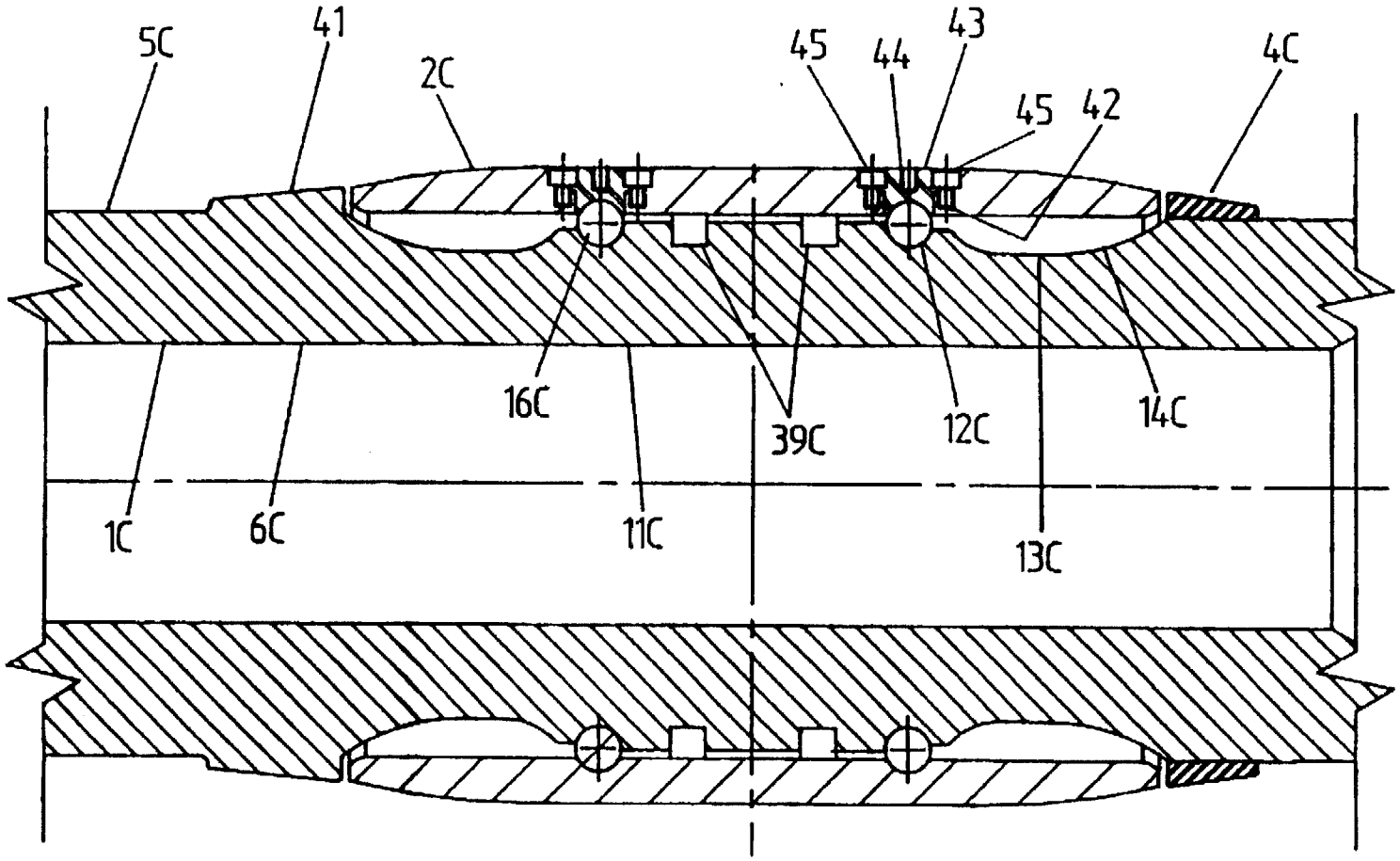
FIG. 16 is a longitudinal section taken in a vertical plane through the axis of the fourth embodiment of sub-assembly of FIG. 15.
Figure 17:
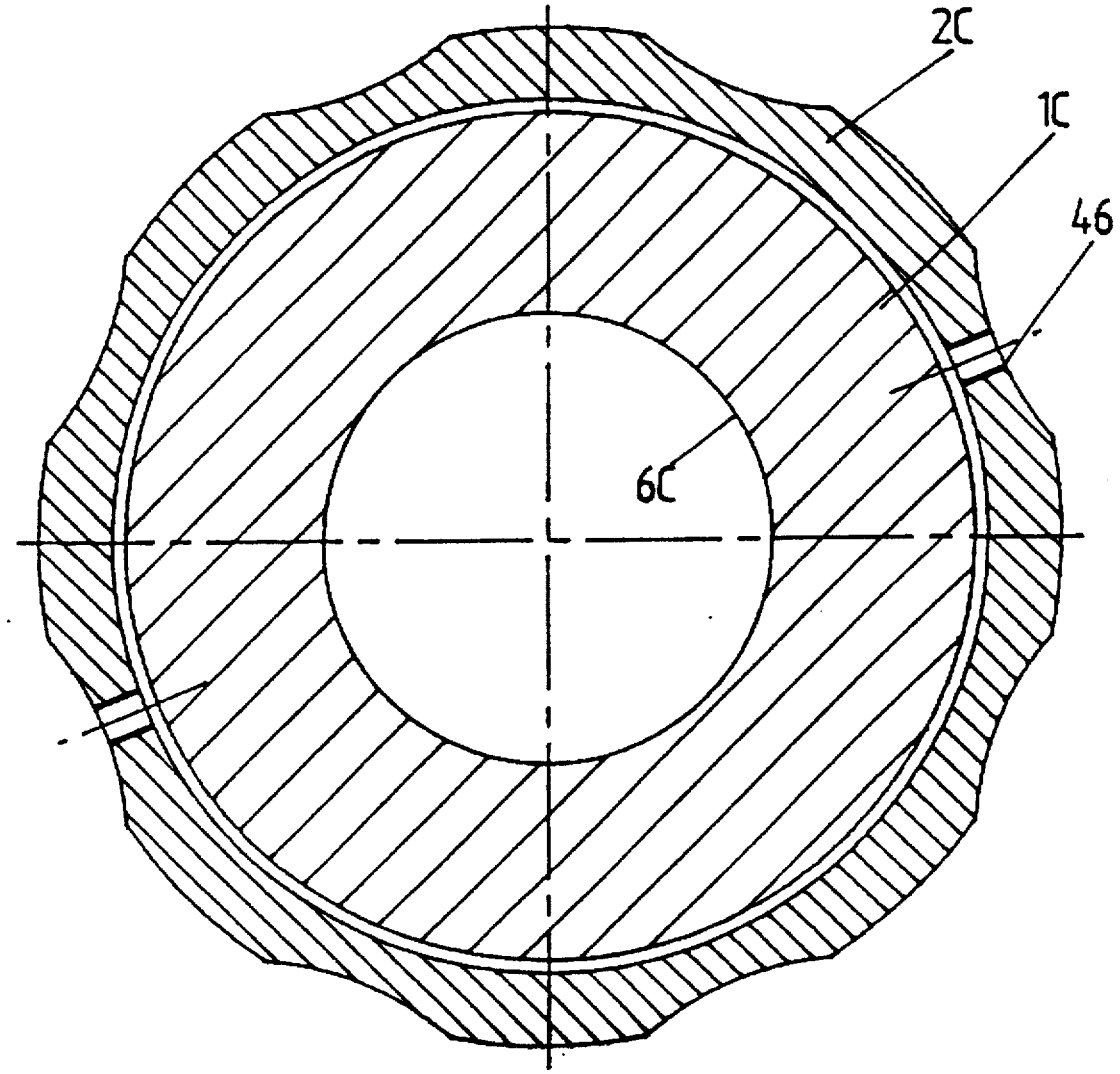
FIG. 17 is a cross-section taken along the line XVII—XVII in FIG. 15.
Figure 18:
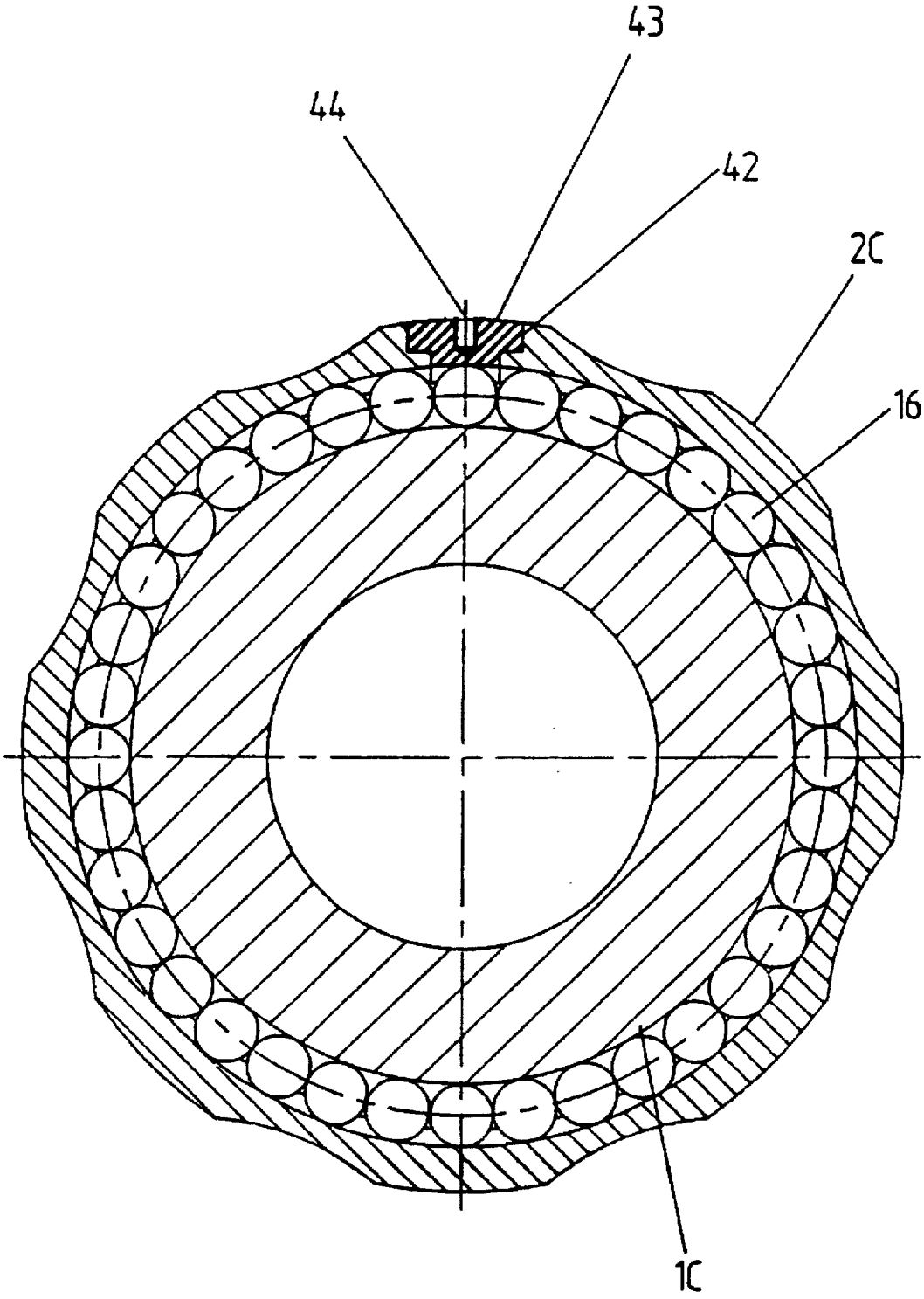
FIG. 18 is a cross-section taken along the line XVIII—XVIII in FIG. 15.

The arrangement illustrated in FIGS. 15 to 18 also contemplates the use of roller bearings and, for this purpose, grooves 39C are provided only in the external surface of the mandrel 1C, to allow the sleeve 2C to be slid over the mandrel 1C from the right hand end (as shown in FIG. 16). The mandrel 1C is provided with an abutment 41 to prevent excessive movement to the left (in FIG. 16) of the sleeve 2C, and then, once the sleeve 2C is in location correctly, a ring 4C is heat shrunk onto the mandrel 1C adjacent the right hand end (in FIG. 16) of the sleeve 2C.

The sleeve 2C is also provided with two ports 46 diametrically opposed at a point midway along the length of the sleeve 2C, the ports 46 allowing access to the gap between the mandrel 1C and the sleeve 2C.

Although not shown in any of the different embodiments illustrated in the drawings, nonetheless certain regions of the external surface of the mandrel and/or the internal surface of the sleeve could be provided with inserts formed of a wear-resistant material, such as a tungsten carbide or a ceramic material.

We claim:

1. A drill string torque-reducing sub-assembly comprising:

a hollow longitudinally-extending one-piece mandrel capable of being coupled between adjacent first and second drill pipes in the drill string;

a sleeve freely rotatable about the mandrel, the sleeve having an external diameter larger than that of any connection component of the first or second drill pipe, and the sleeve being prevented by means mounted internally of the sleeve from longitudinal displacement relative to the mandrel; and bearing means to allow free rotation of the sleeve about the mandrel:

wherein the mandrel has (a) a central region which serves as a hub, (b) two circumferential grooves at opposite ends of the central region, and (c) two legs which extend longitudinally outwardly beyond the two grooves;

wherein the bearing means comprises two ball races, the balls of the ball races being partially located in the respective circumferential grooves, the grooves each forming a first portion of one of the ball races;

wherein the sleeve extends over the hub, over the circumferential grooves and over at least the majority of the legs of the mandrel;

wherein the sleeve has concave regions each forming a second portion of one of the ball races and which partially accommodate the balls of the ball races for cooperation with the grooves to prevent longitudinal displacement of the sleeve relative to the mandrel while allowing free rotation of the sleeve about the mandrel; and wherein the diameter of the hub exceeds the diameter of the circumferential grooves, and the diameter of the grooves exceeds the diameter of the legs, whereby the legs are free to flex without compromising or inhibiting the ability of the mandrel to rotate freely with respect to the sleeve.

2. A sub-assembly as claimed in claim 1, wherein the mandrel has first and second opposing longitudinal ends, with the first end having a male connection component capable of being connected to a female connection component of a first drill pipe, and with the second end having a female connection component capable of being connected to a male connection component of a second drill pipe.

3. A sub-assembly as claimed in claim 1 or 2, wherein the sleeve is formed from two half-sleeves which are generally semi-cylindrical in form, the half-sleeves being provided with means for securing the two half-sleeves to each other securely around the mandrel.

4. A sub-assembly as claimed in claim 1 or 2, wherein the sleeve has a generally smooth exterior.

5. A sub-assembly as claimed in claim 1 or 2, wherein the sleeve has blades and carries, in the region of its blades, captive rotatable means selected from bearings and wheels, with only part of the captive rotatable means exposed to contact the internal surface of the casing or the side wall of the bore.

6. A sub-assembly as claimed in claim 1, which includes shrunk-on rings which are shrunk onto the mandrel and which are of sufficient diameter externally to protect the leading end regions of the sleeve.

7. A sub-assembly as claimed in claim 1, wherein the two ball races are spaced-apart and are the sole means of support between the sleeve and the mandrel, wherein the mandrel and sleeve form a wide gap, the gap being bridged only by the two sets of ball bearings.

8. A sub-assembly as claimed in claim 1 or 7, wherein, the mandrel is hardened in the region of the grooves to provide increased durability, the hardening in the mandrel being limited to the regions adjacent the grooves, with the legs of the mandrel being left in unhardened form to allow the mandrel to flex freely relative to its midpoint without compromising or inhibiting the ability of the mandrel to rotate freely with respect to sleeve.

9. A sub-assembly as claimed in claim 1, wherein the bearing means has, in addition to the two spaced-apart grooves containing the ball bearing races, two roller races located in the hub of the mandrel, the overall clearance between the mandrel and the sleeve being greater in the region of the rollers than in the region of the ball bearing races, in order to allow the mandrel to be able to flex relative to the sleeve.

10. A sub-assembly as claimed in claim 1 or 2, wherein the sleeve is one-piece.

11. A sub-assembly as claimed in claim 10, further including at least two ports in the sleeve for the introduction of balls into the ball bearing races and at least two retaining caps for capping the ports to prevent release of the balls.

12. A sub-assembly according to claim 1, which includes seals to minimize the invasion of drilling fluid into the bearing area.

13. A drill string comprising a plurality of drill pipes and one or more than one sub-assembly as claimed in claim 1 located between the drill pipes.

14. A sub-assembly according to claim 1, wherein each of the circumferential grooves has a first radial surface portion and each of the concave regions has a second radial surface portions, the second radial surface portions respectively facing and radially overlapping the first radial surface portions for cooperation therewith to trap the balls therebetween.

15. A sub-assembly according to claim 1, wherein the sleeve has an inner diameter less than the diameter of the hub.

* * * * *